US009329618B2

(12) United States Patent
Kim et al.

(10) Patent No.: US 9,329,618 B2
(45) Date of Patent: May 3, 2016

(54) APPARATUS FOR REDUCING EFFORT OF CLUTCH PEDAL FOR VEHICLE

(71) Applicants: Hyundai Motor Company, Seoul (KR); Kyung Chang Industrial Co., Ltd., Daegu (KR)

(72) Inventors: Eun Sik Kim, Gwangmyeong-si (KR); Bum Jun Kim, Bucheon-si (KR); Jeong Seon Min, Gwangju (KR); Jong Hee Han, Chilgok-gun (KR)

(73) Assignees: Hyundai Motor Company, Seoul (KR); Kyung Chang Industrial Co., Ltd., Daegu (KR)

( * ) Notice: Subject to any disclaimer, the term of this patent is extended or adjusted under 35 U.S.C. 154(b) by 22 days.

(21) Appl. No.: 14/464,341

(22) Filed: Aug. 20, 2014

(65) Prior Publication Data

US 2015/0153762 A1 Jun. 4, 2015

(30) Foreign Application Priority Data

Dec. 3, 2013 (KR) ..... 10-2013-0149377

(51) Int. Cl.

| | |
|---|---|
| ***G05G 1/30*** | (2008.04) |
| ***G05G 5/04*** | (2006.01) |
| ***G05G 1/44*** | (2008.04) |

(52) U.S. Cl.

CPC .. *G05G 5/04* (2013.01); *G05G 1/44* (2013.01); *Y10T 74/20888* (2015.01)

(58) Field of Classification Search

CPC ..... G05G 1/445; G05G 1/44; G05G 1/327; G05G 1/40; G05G 1/30; G05G 1/38; G05G 5/05; G05G 5/28; G05G 5/12; G05G 5/03; G05G 7/02; G05G 7/04; Y10T 74/20888; Y10T 74/20528; Y10T 74/20534; Y10T 74/20582; Y10T 74/20055; Y10T 74/2054; B60K 23/00; B60K 23/02; B60K 26/021; B60K 26/02; B60K 26/04

See application file for complete search history.

(56) References Cited

U.S. PATENT DOCUMENTS

| | | | | |
|---|---|---|---|---|
| 2004/0200309 | A1* | 10/2004 | Hasegawa et al. | 74/513 |
| 2014/0060239 | A1* | 3/2014 | Hemmege Venkatappa et al. | 74/512 |

FOREIGN PATENT DOCUMENTS

| | | | |
|---|---|---|---|
| JP | S61-27730 | U | 2/1986 |
| KR | 1998-046623 | A | 9/1998 |
| KR | 1998-051416 | A | 9/1998 |
| KR | 10-2007-0062122 | A | 6/2007 |
| KR | 10-0820241 | B1 | 4/2008 |
| KR | 10-2008-0051226 | A | 6/2008 |
| KR | 10-2009-0071030 | A | 7/2009 |

* cited by examiner

*Primary Examiner* — Richard W Ridley
*Assistant Examiner* — Yamilka Pinero Medina
(74) *Attorney, Agent, or Firm* — Morgan, Lewis & Bockius LLP

(57) ABSTRACT

An apparatus for reducing an effort of a clutch pedal for a vehicle may include a hinge pipe provided in an upper portion of a pedal arm so that a pedal hinge penetrates the hinge pipe and having a plurality of pipe protrusions which protrude in a radial direction along a circumferential direction of the hinge pipe on an outer peripheral surface of the hinge pipe, a spring housing fixedly installed on an inside of a pedal member facing the hinge pipe, and a leaf spring positioned in an inner space of the spring housing and fixedly installed in the spring housing to be flexibly bent and having a curve portion contacting one or each of the pipe protrusions.

6 Claims, 8 Drawing Sheets

APPARATUS FOR REDUCING EFFORT OF CLUTCH PEDAL FOR VEHICLE

CROSS-REFERENCE TO RELATED APPLICATION

The present application claims priority of Korean Patent Application Number 10-2013-0149377 filed on Dec. 3, 2013, the entire contents of which application are incorporated herein for all purposes by this reference.

BACKGROUND OF INVENTION

1. Field of Invention

The present invention relates to an apparatus for reducing the effort of a clutch pedal for a vehicle, and more particularly, to a technology associated with an apparatus for reducing the effort of a clutch pedal for a vehicle which can reduce an effort felt by a driver in operating a pedal and is usable without damage to a part even in a vehicle using a high-powered engine having a high output.

2. Description of Related Art

In a manual transmission vehicle, in a state in which a clutch disk and a flywheel are connected to each other so as to transfer power, power of an engine can be smoothly transferred to a transmission only when a slip does not occur between the clutch disk and the flywheel.

Meanwhile, as vehicle performance is improved, a high-powered engine having a high output is gradually used and when the high-powered engine is used, spring force of a diaphragm needs further to increase than the related art for complete connection of the clutch disk and the flywheel. Therefore, there is a scheme that increases a diameter of a turnover spring in order to increase the spring force.

However, when the spring force of the turnover spring is increased, an effort applied to a clutch pedal is increased, and as a result, fatigue of a driver when operating the pedal is relatively increased, and in particular, when the diameter of a turnover spring is increased, a concentrative load applied to the turnover spring is increased, parts including a spring bush connecting the turnover spring and a pedal member, and the like are easily broken.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an apparatus for reducing an effort needed for the operation of a clutch pedal for a vehicle that can reduce an effort felt by a driver in operating a pedal and is usable without damage to a part even in a vehicle using a high-powered engine having a high output.

In various aspects, the present invention provides an apparatus for reducing an effort needed for the operation of a clutch pedal for a vehicle, including: a hinge pipe provided in an upper portion of a pedal arm so that a pedal hinge penetrates the hinge pipe and having a plurality of pipe protrusions which protrude in a radial direction along a circumferential direction of the hinge pipe on an outer peripheral surface of the hinge pipe; a spring housing fixedly installed on an inside of a pedal member facing the hinge pipe; and a leaf spring positioned in an inner space of the spring housing and fixedly installed in the spring housing to be flexibly bent and having a curve portion contacting one or each of the pipe protrusions.

The hinge pipe may be positioned and installed inside of the leaf spring, and the curve portion may be protruded inward toward the one or each of the pipe protrusions.

The one or each of the pipe protrusions may contact one surface of the curve portion in an initial state in which the pedal arm is maximally rotated toward a driver and the one or each of the pipe protrusions may contact the other surface of the curve portion in a full stroke state in which the pedal arm is maximally rotated forward.

When the one or each of the pipe protrusions passes through the curve portion, the leaf spring may be elastically extended outward and after the one or each of the pipe protrusions passes through the curve portion, the leaf spring may be contracted inward to be restored to an original form.

While the pedal arm is rotated from the initial state to the full stroke state, an overlapping amount of the one or each of the pipe protrusions to the curve portion in the full stroke state of the pedal arm may be larger than an overlapping amount of the one or each of the pipe protrusions to the curve portion in the initial state of the pedal arm so as to generate a large reduction force to the effort when the one or each of the pipe protrusions passes through the curve portion.

Upper and lower portions of the leaf spring may be coupled to be fixed to the spring housing in a substantially vertical direction, and the curve portion may be formed at a horizontal position of the leaf spring. Left and right portions of the leaf spring positioned in a substantially horizontal direction may be coupled to be fixed to the spring housing, and the curve portion may be formed at a substantially vertical position of the leaf spring.

The leaf spring may integrally or monolithically formed in a closed curve shape having an inner space. The leaf spring may include two separated leaf springs installed at positions substantially symmetrical to each other around the hinge pipe.

According to various of the present invention, an effort of a driver can be significantly reduced when a pedal arm is rotated by a driver's operation, and as a result, fatigue of the driver operating a pedal can be significantly reduced, and further a complete return of the pedal arm can be induced in an initial operation of the pedal arm or in returning to the rear of the pedal arm to achieve more complete connection of a clutch disk and a flywheel, thereby sufficiently using an apparatus for reducing an effort of a clutch pedal for a vehicle without damage to a part even a high-powered vehicle having a high output.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary embodiments thereof illustrated in the accompanying drawings which are given herein below by way of illustration only, and thus are not limitative of the present invention, and wherein.

Figure 1:
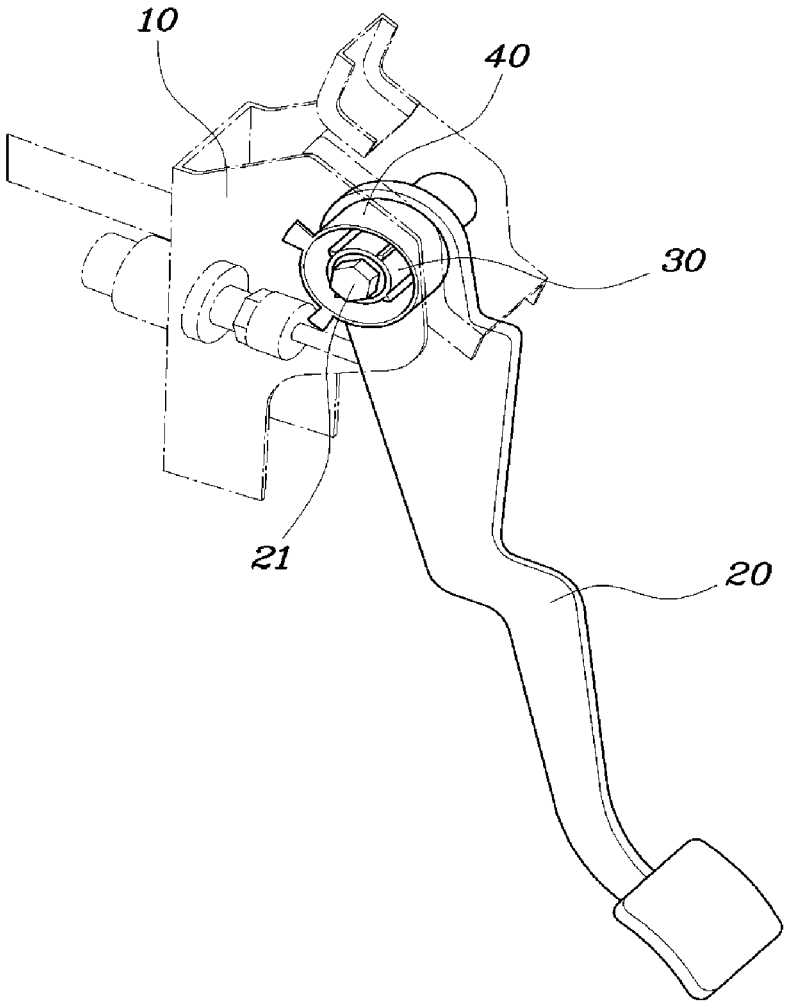
FIGS. 1 and 2 are a perspective view and a front view of a clutch pedal to which an exemplary apparatus for reducing an effort is applied according to the present invention.
Figure 2:
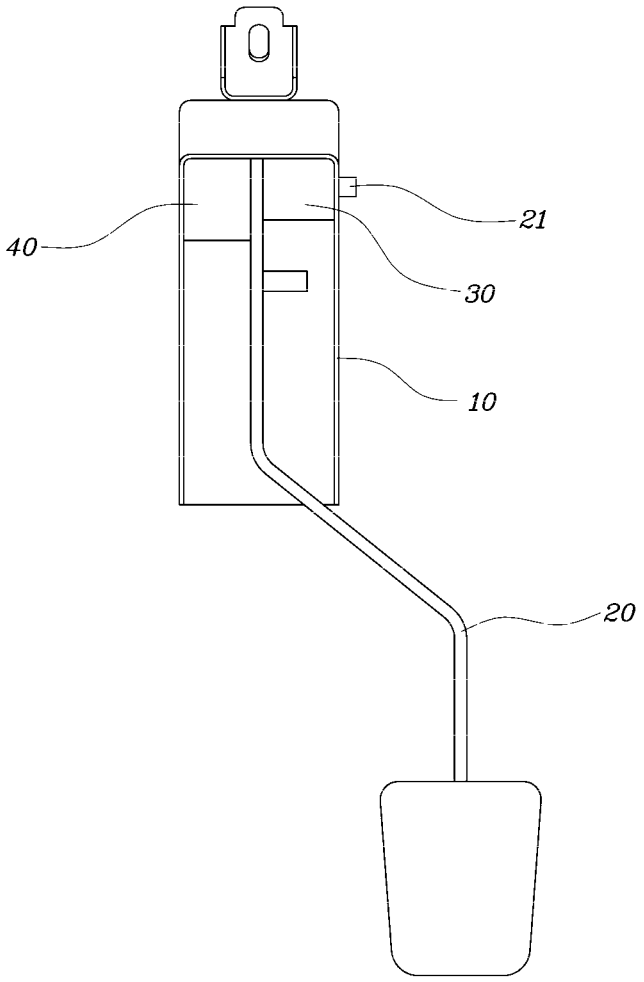
Figure 3:
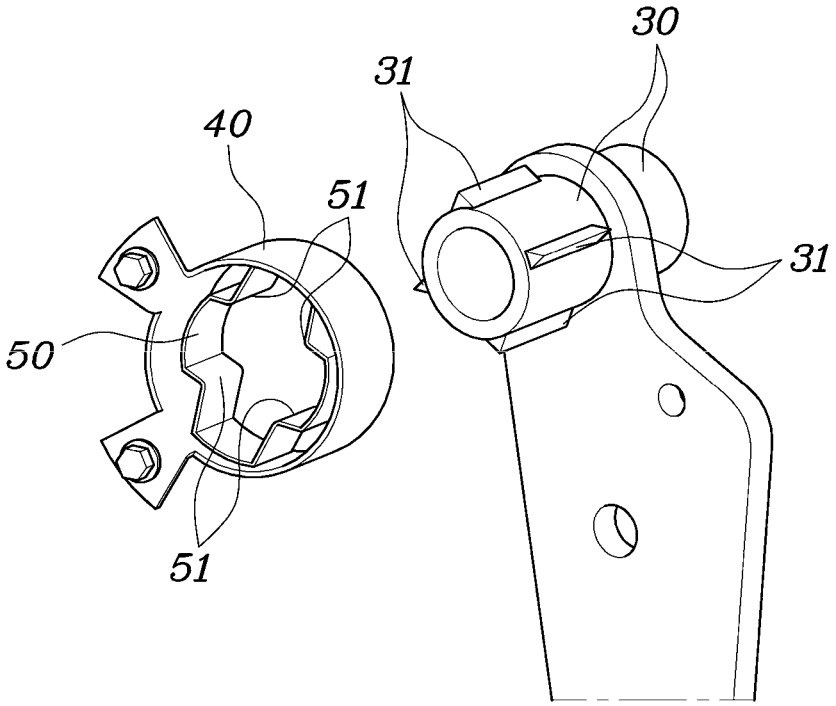
FIG. 3 is an exploded perspective view of an exemplary apparatus for reducing an effort of a clutch pedal according to the present invention.

It should be understood that the appended drawings are not necessarily to scale, presenting a somewhat simplified representation of various preferred features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

The apparatus for reducing an effort of a clutch pedal for a vehicle according to the present invention is configured to include a pedal member 10 fixedly installed in a front chassis panel (dash panel) adjacent the lower part of a driver seat; a pedal arm 20 installed in the pedal member 10 with an upper portion to be rotatable through a pedal hinge 21; a hinge pipe 30 provided in the upper portion of the pedal arm 20 so that the pedal hinge 21 penetrates the pipe and having a plurality of pipe protrusions 31 which are protruded in a radial direction along the circumferential direction on an outer peripheral surface; a spring housing 40 fixedly installed on an inner side of the pedal member 10 facing the hinge pipe 30; and a leaf spring 50 positioned in an inner space of the spring housing 40 and fixedly installed in the spring housing 40 to be flexibly bent and having a curve portion 51 contacting the pipe protrusion 31, as illustrated in FIGS. 1 to 6.

Here, the hinge pipe 30 is coupled with the pedal arm so as to penetrate the upper portion of the pedal arm 20 and the hinge pipe 30 is positioned and installed in an inner space of the pedal member 10, and in this state, as the pedal hinge 21 is installed by integrally penetrating both sides of the hinge pipe 30 and the pedal member 10, the upper portion of the pedal arm 20 is rotatably installed forward and backward relative to the pedal member 10 through the pedal hinge 21.

The pipe protrusions 31 are spaced apart from each other and in some embodiments at regular intervals along the circumferential direction of the hinge pipe 30 and an exemplary embodiment of the present invention provides a structure in four pipe protrusions 31 which are formed at an interval of 90°, but is not limited thereto.

The spring housing 40 has a cylindrical structure and is fixedly installed in the pedal member 10 through coupling members 41 such as a plurality of bolts or screws.

According to the present invention, the hinge pipe 30 is positioned and installed in the leaf spring 50 and the curve portion 51 of the leaf spring 50 is protruded inward toward the pipe protrusion 31.

Figure 4:
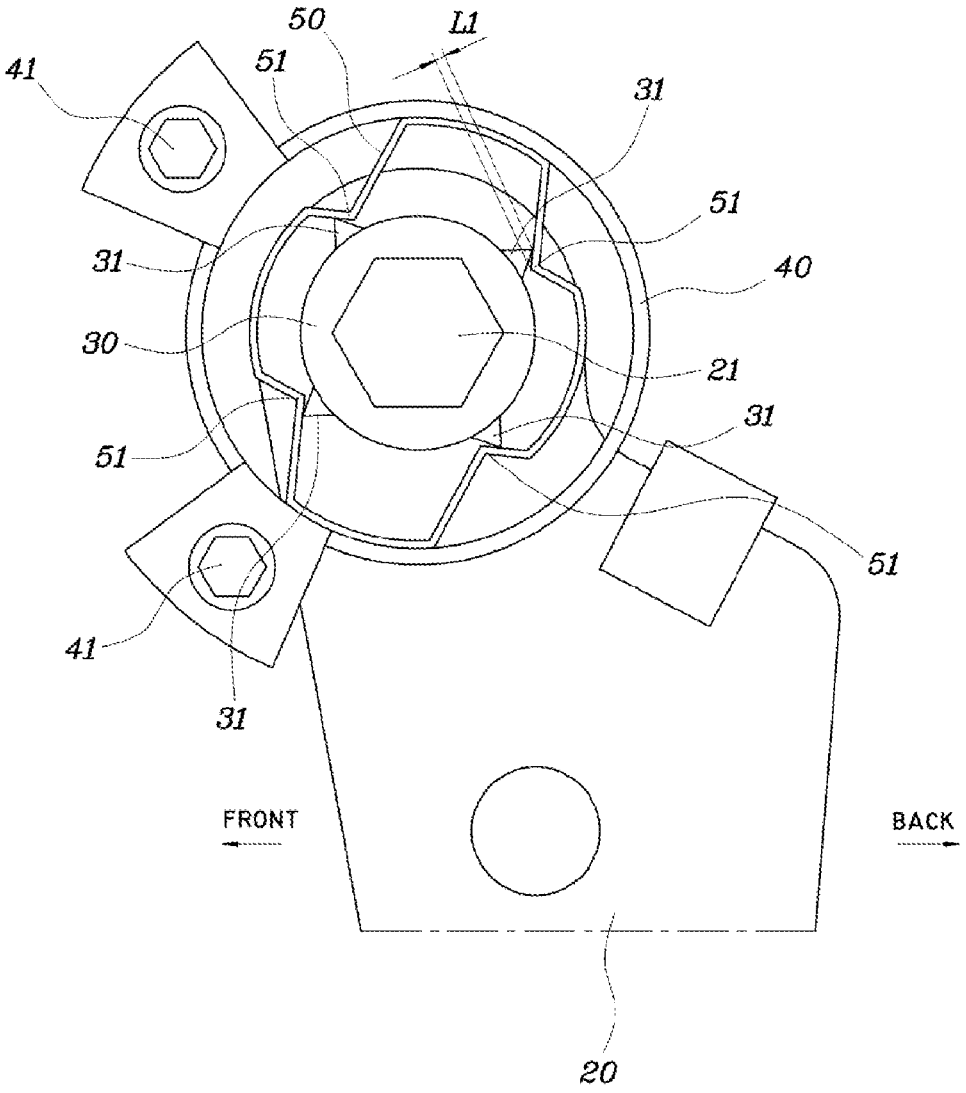
FIG. 4 is a front view of a combination state of an exemplary apparatus for reducing an effort of a clutch pedal according to the present invention, and is a diagram in an initial state in which a pedal arm is maximally rotated toward a driver.
Figure 6:
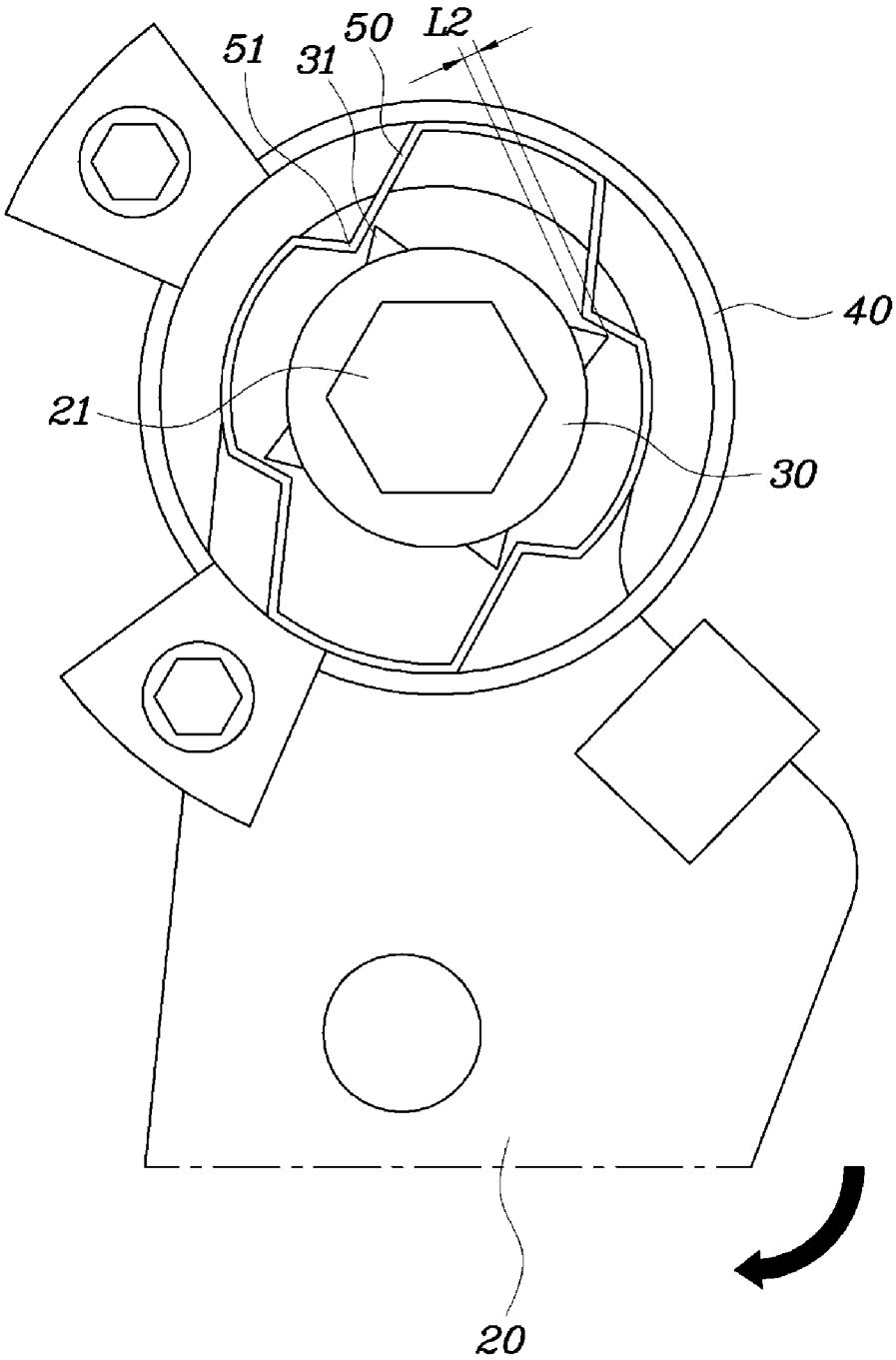
FIG. 6 is a diagram in a full-stroke operation state of the pedal arm.

In an initial state in which the pedal arm 20 is maximally rotated toward a driver as illustrated in FIG. 4, the pipe protrusion 31 contacts one surface of the curve portion 51, and in a full stroke state in which the pedal arm 20 is maximally rotated forward as illustrated in FIG. 6, the pipe protrusion 31 contacts the other surface of the curve portion 51.

Figure 5:
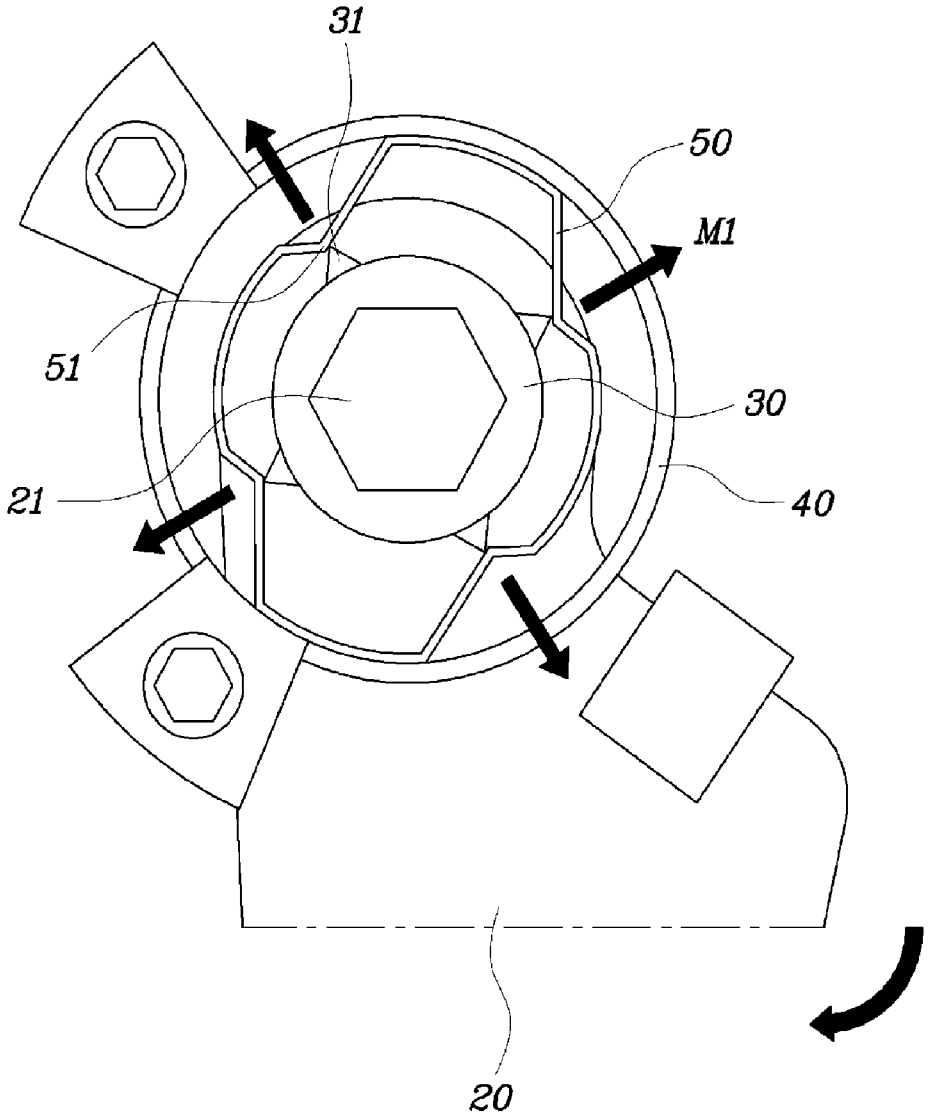
FIG. 5 is a diagram in an initial operation state of the pedal arm in FIG. 4.

In addition, the leaf spring 50 is flexibly extended outward when the pipe protrusion 31 passes through the curve portion 51 as illustrated in FIG. 5 (arrow M1), and is restored to an original form while being contracted inward after the pipe protrusion 31 passes through the curve portion 51, as illustrated in FIG. 6.

Meanwhile, while the pedal arm 30 is rotated from the initial state illustrated in FIG. 4 to the full stroke state illustrated in FIG. 6, an overlapping amount L2 (see FIG. 6) of the pipe protrusion 31 to the curve portion 51 in the full stroke state of the pedal arm 20 is larger than an overlapping amount L1 (see FIG. 4) of the pipe protrusion 31 to the curve portion 51 in the initial state of the pedal arm 20 so as to generate a large reduction force to the effort when the pipe protrusion 31 passes through the curve portion 51.

The leaf spring 50 according to some embodiments of the present invention has a structure in which upper and lower portions of the leaf spring 50 are coupled to be fixed to the spring housing 40 in a vertical or substantially vertical direction as illustrated in FIGS. 3 to 6 and in this case, the curve portion 51 is formed at a horizontal or substantially horizontal position of the leaf spring 50.

Figure 7:
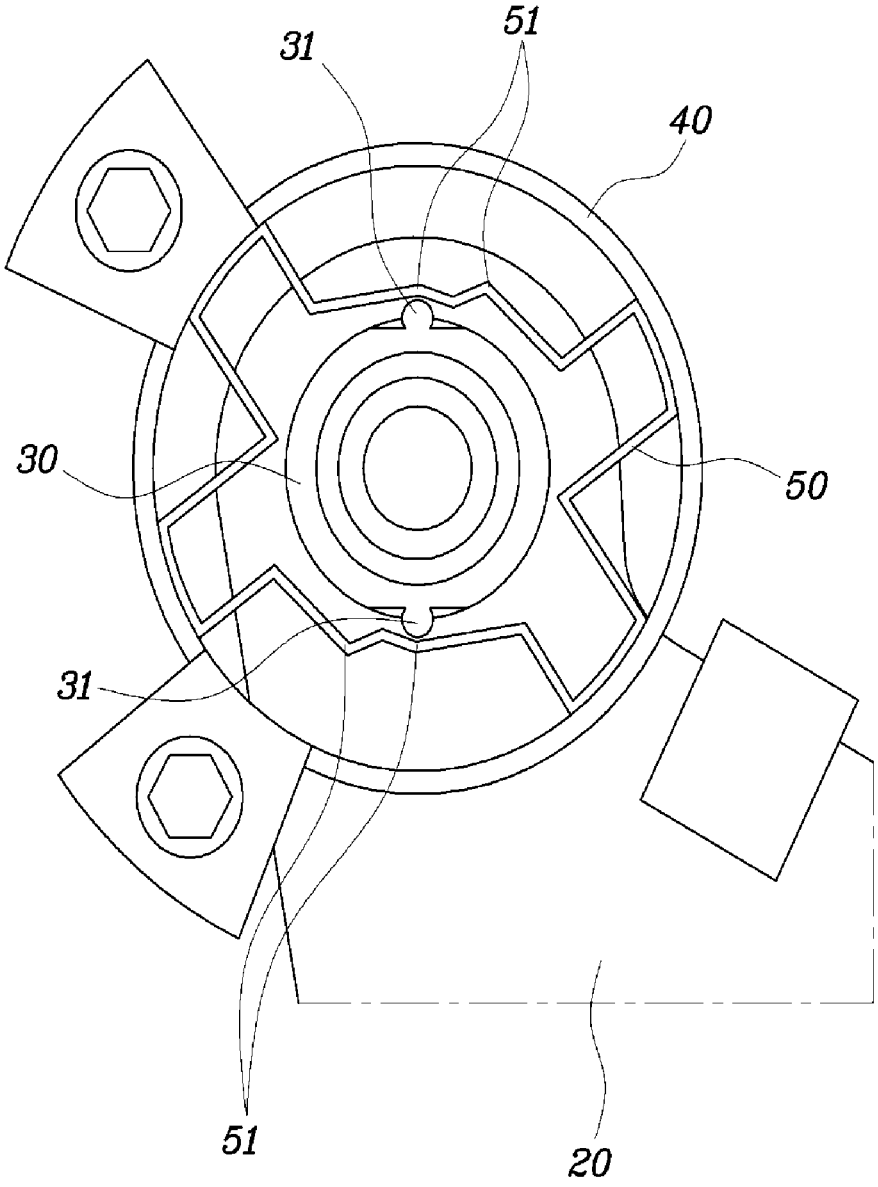
FIGS. 7 and 8 are diagrams for describing an exemplary apparatus with exemplary leaf springs according to the present invention.

Further, according to some other embodiments, the leaf spring 50 has a structure in which left and right portions of the leaf spring 50 positioned in a horizontal or substantially horizontal direction are coupled to be fixed to the spring housing 40 in a vertical direction as illustrated in FIG. 7 and in this case, the curve portion 51 is formed at a vertical or substantially vertical position of the leaf spring 50.

Figure 8:
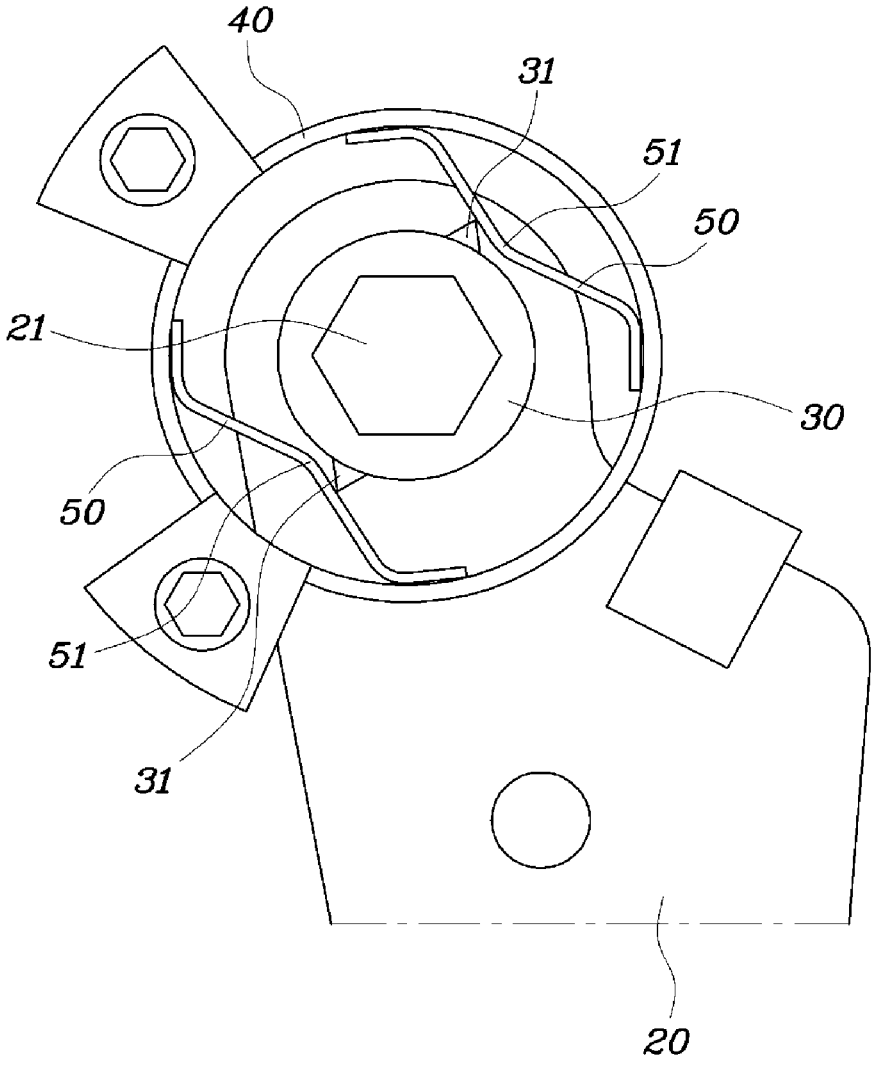

In addition, the leaf spring 50 according to an embodiment of the present invention has an integrally formed closed curve shape having an inner space, as illustrated in FIGS. 3 to 7, or is divided into two and two divided leaf springs 50 may be installed at positions symmetrical or substantially symmetrical to each other around the hinge pipe 30, as illustrated in FIG. 8.

Hereinafter, an operation of the embodiment of the present invention will be described.

The state of FIG. 4 is a state where the pedal arm 20 is maximally rotated toward a driver, that is, a state before the driver presses the pedal arm 20 or an initial state before applying force to the pedal arm 20, and in this case, the pipe protrusion 31 of the hinge pipe 30 contacts one surface of the curve portion 51 of the leaf spring 50.

FIG. 5 illustrates an initial operation state of the pedal arm 20 and in this case, the pipe protrusion 31 is positioned at a maximum apex (inflection point) of the curve portion 51, and as a result, elastic accumulation force of the leaf spring 50 becomes maximized and the elastic accumulation force of the leaf spring 50 is transferred to the pedal arm 20 through the hinge pipe 30. Therefore, the pedal arm 20 receives force to rotate to a rear side at which the driver is positioned, and as a result, a complete return of the pedal arm 20 may be induced and a more complete connection of the clutch disk and the flywheel may be achieved, thereby sufficiently using the apparatus for reducing an effort of a clutch pedal for a vehicle without damage to a part even in a high-powered vehicle having a high output.

In addition, when the initial state illustrated in FIG. 4 is changed to the initial operation state illustrated in FIG. 5, as elastic force of the leaf spring 50 is transferred to the pedal arm 20 through the hinge pipe 30, the effort needed by a driver is gradually increased and in this case, the driver can perceive the operation state of the pedal arm 20 through a reaction force transferred from the pedal arm 20.

In addition, when the pipe protrusion 31 is positioned at the maximum apex (inflection point) of the curve portion 51 as illustrated in FIG. 5, the elastic accumulation force of the leaf spring 50 becomes maximized, and as a result, the reaction force by the leaf spring 50 becomes maximized and in this case, the effort needed by the driver also becomes maximized.

FIG. 6 illustrates a state in which the pipe protrusion 31 passes through the curve portion 51 of the leaf spring 50 by continuous forward rotation of the pedal arm 20, that is, the full stroke operation state of the pedal arm 20, and in this case, the clutch is disconnected.

When the pipe protrusion 31 passes through the curve portion 51 while the initial operation state illustrated in FIG. 5 is changed to the full stroke state illustrated in FIG. 6, the leaf spring 50 pushes the pipe protrusion 31 by accumulated elastic force, and as a result, a large reduction force for the effort may be generated. Therefore, the effort needed by the driver is significantly reduced, and as a result, the fatigue of the driver is reduced when the pedal arm 20 is actuated due to the reduced effort.

Meanwhile, according to the present invention, in a structure in which the overlapping amount of the pipe protrusion 31 to the curve portion 51 in the full stroke state illustrated in FIG. 6 is larger than the overlapping amount of the pipe protrusion 31 of the curve portion 51 in the initial state illustrated in FIG. 4 ($L1<L2$), the leaf spring 50 pushes the pipe protrusion 31 with a large elastic force when the pipe protrusion 31 passes through the curve portion 51, and as a result, a large reduction force may be generated. Therefore, the effort needed by the driver may be significantly reduced.

As described above, according to various embodiments of the present invention, in the initial operation and the rear return of the pedal arm 20, complete return of the pedal arm 20 may be induced by the elastic force of the leaf spring 50 to achieve more complete connection of the clutch disk and the flywheel, and as a result, the apparatus for reducing an effort may be sufficiently used without damage to the part even in the high-powered vehicle having a high engine output.

Further, the leaf spring 50 pushes the pipe protrusion 31 with the large accumulated elastic force when the pipe protrusion 31 passes through the curve portion 51 according to the full stroke operation of the pedal arm 20 to generate a large reduction force and the effort transferred to the pedal arm 20 may be significantly reduced, thereby significantly reducing the fatigue of a driver according to the operation of the pedal arm 20.

For convenience in explanation and accurate definition in the appended claims, the terms "upper" or "lower", "front" or "rear", "inner" or "outer", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings.

The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for reducing an effort of a clutch pedal for a vehicle, comprising:

a hinge pipe provided in an upper portion of a pedal arm so that a pedal hinge is configured to penetrate the hinge pipe, and having a plurality of pipe protrusions protruding in a radial direction along a circumferential direction of the hinge pipe on an outer peripheral surface of the hinge pipe;

a spring housing fixedly installed on an inside of a pedal member facing the hinge pipe; and a leaf spring positioned in an inner space of the spring housing and fixedly installed in the spring housing to be flexibly bent and having a curved portion selectively contacting one or each of the pipe protrusions, wherein the leaf spring is formed in a closed curve shape, wherein one or each of the pipe protrusions contacts a first surface of the curved portion in an initial state in which the pedal arm is maximally rotated toward a driver, wherein the one or each of the pipe protrusions contacts a second surface of the curved portion in a full stroke state in which the pedal arm is maximally rotated forward, and wherein, while the pedal arm is rotated from the initial state to the full stroke state, an amount of the one or each of the pipe protrusions overlapping the curved portion in the full stroke state of the pedal arm is larger than an amount of the one or each of the pipe protrusions overlapping the curved portion in the initial state of the pedal arm so as to generate a reduction force to the effort when the one or each of the pipe protrusions passes through the curved portion.

2. The apparatus of claim 1, wherein:

the hinge pipe is positioned and installed inside of the leaf spring, and the curved portion is protruded inward toward the one or each of the pipe protrusions.

3. The apparatus claims 1, wherein:

when the one or each of the pipe protrusions passes through the curved portion, the leaf spring is configured to be elastically extended outward and after the one or each of the pipe protrusions passes through the curved portion, the leaf spring is configured to be contracted inward to be restored to an original form.

4. The apparatus of claim 1, wherein:

upper and lower portions of the leaf spring are coupled to be fixed to the spring housing in a substantially vertical direction; and the curved portion is formed at a substantially horizontal position of the leaf spring.

5. The apparatus of claim 1, wherein:

left and right portions of the leaf spring positioned in a substantially horizontal direction are coupled to be fixed to the spring housing, and the curved portion is formed at a substantially vertical position of the leaf spring.

6. The apparatus of claim 1, wherein:

the leaf spring is integrally or monolithically formed in the closed curve shape having an inner space.

* * * * *